US007675245B2

(12) United States Patent
Szczeszynski et al.

(10) Patent No.: US 7,675,245 B2
(45) Date of Patent: Mar. 9, 2010

(54) ELECTRONIC CIRCUIT FOR DRIVING A DIODE LOAD

(75) Inventors: Gregory Szczeszynski, Nashua, NH (US); Shashank Wekhande, Nashua, NH (US); Vijay Mangtani, Nashua, NH (US)

(73) Assignee: Allegro Microsystems, Inc., Worcester, MA (US)

( * ) Notice: Subject to any disclaimer, the term of this patent is extended or adjusted under 35 U.S.C. 154(b) by 132 days.

(21) Appl. No.: 11/619,675

(22) Filed: Jan. 4, 2007

(65) Prior Publication Data

US 2008/0164828 A1 Jul. 10, 2008

(51) Int. Cl.
*G05F 1/00* (2006.01)
*G09G 5/00* (2006.01)

(52) U.S. Cl. ..... 315/291; 315/307; 315/247; 315/185 S; 315/312; 345/212; 345/211; 345/204; 345/102

(58) Field of Classification Search ..... 315/247, 315/246, 224, 225, 291, 294, 297–302, 306–311, 315/312, 314, 324, 185 S; 361/83, 88–90, 361/91, 91.3, 91.5, 92, 93.1, 103, 106; 345/102, 345/204, 211, 214
See application file for complete search history.

(56) References Cited

U.S. PATENT DOCUMENTS 6,222,385 B1 4/2001 Kang
6,621,235 B2 9/2003 Chang
6,636,104 B2 10/2003 Henry
6,690,146 B2 2/2004 Burgyan et al.
6,822,403 B2 11/2004 Horiuchi et al.
6,930,679 B2 8/2005 Wu et al.
7,116,086 B2 10/2006 Burgyan et al.
7,291,989 B2 11/2007 Namba et al.
7,317,403 B2 1/2008 Grootes et al.
7,479,743 B2 * 1/2009 Namba et al. ..... 315/307
7,482,765 B2 1/2009 Ito et al.
2004/0135522 A1 7/2004 Berman et al.

(Continued)

FOREIGN PATENT DOCUMENTS

EP 1 079 667 A2 2/2001

(Continued)

OTHER PUBLICATIONS

Partial PCT Search Report received with Invitation to Pay Additional Fees in PCT/US2008/050026 dated Jun. 16, 2008.

(Continued)

*Primary Examiner*—Tuyet Vo
(74) *Attorney, Agent, or Firm*—Daly, Crowley, Mofford & Durkee, LLP

(57) ABSTRACT

An electronic circuit includes circuit portions for identifying a largest voltage drop through one of a plurality of series connected diode strings and for controlling a boost switching regulator according to the largest voltage drop. The electronic circuit can sense an open circuit series connected diode string, which would otherwise have the largest voltage drop, and can disconnect that open circuit series connected diode string from control of the boost switching regulator. Another electronic circuit includes a current limiting circuit coupled to or within a boost switching regulator and configured to operate with a diode load. Another electronic circuit includes a pulse width modulation circuit configured to dim a series connected string of light emitting diodes.

12 Claims, 6 Drawing Sheets

U.S. PATENT DOCUMENTS

| | | | | |
|---|---|---|---|---|
| 2005/0088207 | A1* | 4/2005 | Rader et al. | 327/109 |
| 2005/0104542 | A1* | 5/2005 | Ito et al. | 315/291 |
| 2005/0110469 | A1 | 5/2005 | Inaba et al. | |
| 2005/0243022 | A1 | 11/2005 | Negru | |
| 2005/0243041 | A1 | 11/2005 | Vinn | |
| 2006/0114954 | A1 | 6/2006 | Wong et al. | |
| 2006/0125320 | A1 | 6/2006 | Namba et al. | |
| 2006/0139299 | A1 | 6/2006 | Tsuchiya | |
| 2006/0170287 | A1 | 8/2006 | Ito et al. | |
| 2007/0120506 | A1 | 5/2007 | Grant | |
| 2008/0144236 | A1* | 6/2008 | Chiang et al. | 361/18 |

FOREIGN PATENT DOCUMENTS

| | | | |
|---|---|---|---|
| EP | 1 079 667 | A3 | 2/2001 |
| JP | 3-196280 | | 8/1991 |
| WO | WO 00/013310 | | 3/2000 |
| WO | WO 02/03087 | A1 | 1/2002 |
| WO | WO 2007/043389 | A1 | 4/2007 |
| WO | WO 2007/096868 | A1 | 8/2007 |

OTHER PUBLICATIONS

"Charge-Pump and Step-Up DC-DC Converter Solutions for Powering White LEDs in Series or Parallel Connections:" Dallas Semiconductor MAXIM; Apr. 23, 2002; 15 pages.

"White LED Driver IC;" NPC Nippon Precision Circuits, Inc.; SM8132A; May 2005; pp. 1-18.

"WLED Backlight Drivers with True Shutdown and OVP;" A8432 and A8433: Allegro MicroSystems, Inc. Concept Data Sheet; Jan. 25, 2005; 6 pages.

MAXIM Data Sheet; MAX1570; "White LED Current Regulator with 1x/1.5x High-Efficiency Charge Pump;" #19-2526; Jul. 2002; pp. 1-12.

MAXIM Data Sheet; MAX1574; "180mA, 1x/2x, White LED Charge Pump in 3mm x 3mm TDFN;" #19-3117; Dec. 2003; pp. 1-9.

Maxim Data Sheet; MAX1576; "480mA White LED 1x/1.5x./2x Charge Pump for Backlighting and Camera Flash;" #19-3326; Aug. 2005; pp. 1-14.

PCT Search Report and Written Opinion of the ISA for PCT/US2008/050026 dated Aug. 29, 2008.

Bakker et al.; "A CMOS Nested-Chopper Instrumentation Amplifier with 100-nV Offset;" IEEE Journal of Solid-State Circuits; vol. 35, No. 12; Dec. 2000; pp. 1877-1883.

Burkhart et al.; "A Monolithically Integrated 128 LED-Driver and its Application;" IEEE Transactions on Consumer Electronics; vol. CE-32, No. 1; Feb. 1986; pp. 26-31.

Szczeszynski et al.; U.S. Appl. No. 12/267,645, filed on Nov. 10, 2008; Entitled: "Electronic Circuits for Driving Series Connected Light Emitting Diode Strings".

Allegro Microsystems, Inc., Data Sheet A8500, Flexible WLED/RGB Backlight Driver for Medium Size LCD's, Dec. 8, 2006, pp. 1-15.

MAXIM, Data Sheet MAX16807/MAX16808, Integrated 8-Channel LED Drivers with Switch-Mode Boost and SEPIC Controller, Oct. 2006, pp. 1-21.

Rohm, Data Sheet BD6066GU, Silicon Monolithic Integrated Circuit, Apr. 2005, pp. 1-6.

Linear Technology, Design Notes, Short-Circuit Protection for Boost Regulators, 1997, pp. 1-2.

Szczeszynski; U.S. Appl. No. 12/136,347, filed Jun. 10, 2008; Entitled: "Electronic Circuit for Driving a Diode Load With a Predetermined Average Current;" 39 pages.

PCT International Preliminary Report on Patentability of the ISA dated Jul. 16, 2009 for PCT/US2008/050026.

PCT Search Report and Written for the ISA of PCT/US2008/082934 mailed Dec. 15, 2009.

* cited by examiner

ELECTRONIC CIRCUIT FOR DRIVING A DIODE LOAD

CROSS REFERENCE TO RELATED APPLICATIONS

Not Applicable.

STATEMENT REGARDING FEDERALLY SPONSORED RESEARCH

Not Applicable.

FIELD OF THE INVENTION

This invention relates generally to electronic circuits and, more particularly, to electronic circuits used to drive a light emitting diode (LED) load.

BACKGROUND OF THE INVENTION

A variety of electronic circuits are used to drive diode loads and, more particularly, to control electrical current through strings of series connected light-emitting diodes (LEDs), which, in some embodiments, form an LED display. It is known that individual LEDs have a variation in forward voltage drop from unit to unit. Therefore, the strings of series connected LEDs can have a variation in forward voltage drop.

Strings of series connected LEDs can be coupled to a common boost switching regulator at one end of the strings, the boost switching regulator configured to provide a high enough voltage to supply each of the strings of LEDs. The other end of each of the strings of series connected LEDs can be coupled to a respective current sink, configured to sink a relatively constant current through each of the strings of series connected LEDs.

It will be appreciated that the voltage generated by the common boost switching regulator must be a high enough voltage to supply the one series connected string of LEDs having the greatest total voltage drop, plus an overhead voltage needed by the respective current sink. In other words, if four series connected strings of LEDs have voltage drops of 30V, 30V, 30V, and 31 volts, and each respective current sink requires at least one volt in order to operate, then the common boost switching regulator must supply at least 32 volts.

While it is possible to provide a fixed voltage boost switching regulator that can supply enough voltage for all possible series strings of LEDs, such a boost switching regulator would generate unnecessarily high power dissipation when driving strings of series connected LEDs having less voltage drop. Therefore, in some LED driver circuits, the voltage drops through each of the strings of series connected LEDs are sensed and the common boost switching regulator is controlled to generate an output voltage only high enough to drive the series connected LED string having the highest voltage drop.

While the above-described electronic technique can result in a reduction of power dissipation, the above-described electronic technique can also suffer a high power dissipation if one of the series connected strings of LEDs becomes open circuit, i.e., fails. In this situation, a high voltage drop would be sensed and the common boost switching regulator would be controlled to increased its output voltage as high as it is able, resulting in a higher power dissipation associated with the remaining strings of series connected LEDs.

SUMMARY OF THE INVENTION

In accordance with one aspect of the present invention, an electronic circuit includes a current regulator having a current sense node, wherein the current regulator is configured to pass a predetermined current through the current regulator. The electronic circuit also includes an open-circuit detection circuit having an input node and an output node. The input node of the open-circuit detection circuit is coupled to the current sense node of the current regulator. The open-circuit detection circuit is configured to provide an output signal at the output node of the open-circuit detection circuit indicative of a current flowing through the current regulator being below a predetermined current threshold. The electronic circuit also includes a switch having an input node, an output node, and a control node. The input node of the switch is coupled to the current sense node of the current regulator, a selected one of the input node or the output node of the switch is coupled to the input node of the open-circuit detection circuit, and the control node of the switch is coupled to the output node of the open-circuit detection circuit. The open-circuit detection circuit is configured to open the switch in response to the current flowing through the current regulator being below the predetermined current threshold.

Also described is an open circuit protection method for an LED driver circuit comprising a boost switching regulator, which includes drawing a predetermined current through an LED and through a current regulator, detecting a current passing through the current regulator to determine whether the current is less than a predetermined current threshold, and disconnecting the LED from the LED driver circuit in response to a determination that the current passing through the current regulator is less than the predetermined current threshold.

With the above arrangements, open circuit protection is provided by which an open load element or elements coupled to the current regulator is detected and decoupled from the electronic circuit, as may include a boost switching regulator for driving the load, via opening of a respective switch. This arrangement is particularly advantageous in embodiments in which the electronic circuit includes a boost switching regulator that receives, as a feedback, the signal at one or more of the current regulator current sense nodes, since otherwise, an open circuit load condition could cause the switching regulator output voltage to increase excessively as may damage other components and cause significant power dissipation. Advantageously, the open circuit load is not disabled, but simply decoupled from the circuit, thereby permitting the faulty load to again be coupled to the circuit if the fault is temporary.

In some embodiments, the open-circuit detection circuit is configured to open the switch in response to both the signal at the current sense node of the current regulator being below the first predetermined current threshold and the occurrence of another condition, such as an over-voltage condition and/or an over-temperature condition. This arrangement prevents false, perhaps transient, indications of the current regulator current being below the first predetermined current threshold from opening the switch.

In accordance with another aspect of the present invention, an electronic circuit includes a switch having an input node, an output node, and a control node. The electronic circuit also includes a current-passing circuit having first and second nodes. The first node of the current-passing circuit is coupled to the input node of the switch and the second node of the current-passing circuit is coupled to the output node of the switch. The electronic circuit also includes a boost switching regulator having an input node and an output node. The input node of the boost switching regulator is coupled to the output node of the switch and the output node of the boost switching regulator is configured to couple to a diode load. The electronic circuit also includes a resistor having first and second nodes. The first node of the resistor is coupled to the control node of the switch and the second node of the resistor is coupled to the output node of the boost switching regulator.

With this arrangement, a simple short circuit protection scheme is provided whereby the switch is closed during normal operation and open when a short circuit condition occurs. The current-passing circuit allows the electronic circuit to start up and to resume operation following removal of a short circuit condition by allowing a small current to pass. This arrangement is possible because the diode load draws very little current until the switching regulator output voltage reaches a sufficient voltage.

In accordance with another aspect of the present invention, an electronic circuit for dimming a light emitting diode having an anode and a cathode includes a current regulator having a current node and a control node. The current node of the current regulator is configured to couple to the light emitting diode. The electronic circuit also includes a boost switching regulator having an input node, an output node, and a control node. The output node of the boost switching regulator is configured to couple to a selected one of the anode of the light emitting diode or to the current regulator. The boost switching regulator is enabled to switch or is disabled from switching in response to an input signal at the control node of the boost switching regulator. The electronic circuit also includes a pulse width modulation circuit having an output node and a control node. The output node of the pulse width modulation circuit is coupled to the control node of the current regulator. The pulse width modulation circuit is configured to generate an AC output signal at the output node of the pulse width modulation circuit, which enables and disables the current regulator at a predetermined frequency and at a selected duty cycle in response to a respective selected input signal at the input node of the pulse width modulation circuit. The duty cycle is selected in accordance with a selected brightness of the light emitting diode. Substantially simultaneously with the current regulator being disabled, the input signal at the control node of the switching regulator is indicative of the boost switching regulator being disabled.

With this arrangement, the output voltage of the switching regulator is held substantially constant during intervals when the current regulators are disabled by the pulse width modulation. Audible noise that may otherwise be generated due to voltage swings on ceramic capacitors is reduced or eliminated.

In some embodiments, a capacitor is coupled to the control node of the boost switching regulator through a switch that is controlled by the pulse width modulation circuit such that the switch is closed when the current regulator is enabled and open when the current regulator is disabled. With this arrangement, the voltage at the control input to the switching regulator is held substantially constant, at its previous voltage level, during intervals in which the current regulators are disabled by the pulse width modulation circuit, thereby resulting in rapid stabilization of the boost switching regulator control loop during each pulse width modulation cycle.

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, some introductory concepts and terminology are explained. As used herein, the term "boost switching regulator" is used to describe a known type of switching regulator that provides an output voltage higher than an input voltage to the boost switching regulator. While a certain particular circuit topology of boost switching regulator is shown herein, it should be understood that a boost switching regulator can be formed in a variety of circuit configurations.

As used herein, the term "current regulator" is used to describe a circuit or a circuit component that can regulate a current passing through the circuit or circuit component to a predetermined, i.e., regulated, current. A current regulator can be a "current sink," which can input a current, or a "current source," which can output a regulated current. A current regulator has a "current node" at which a current is output in the case of a current source, or at which a current is input in the case of a current sink. For a current sink, the current node is also referred to herein as an "input node" since it inputs a current. For a current source, the current node is also referred to herein as an "output node" since it outputs a current. The current node can be the same node or a different node from a "current sense node," used to sense a current flowing through the current regulator. The current sense node is described more fully below in conjunction with FIG. 1.

Figure 1:
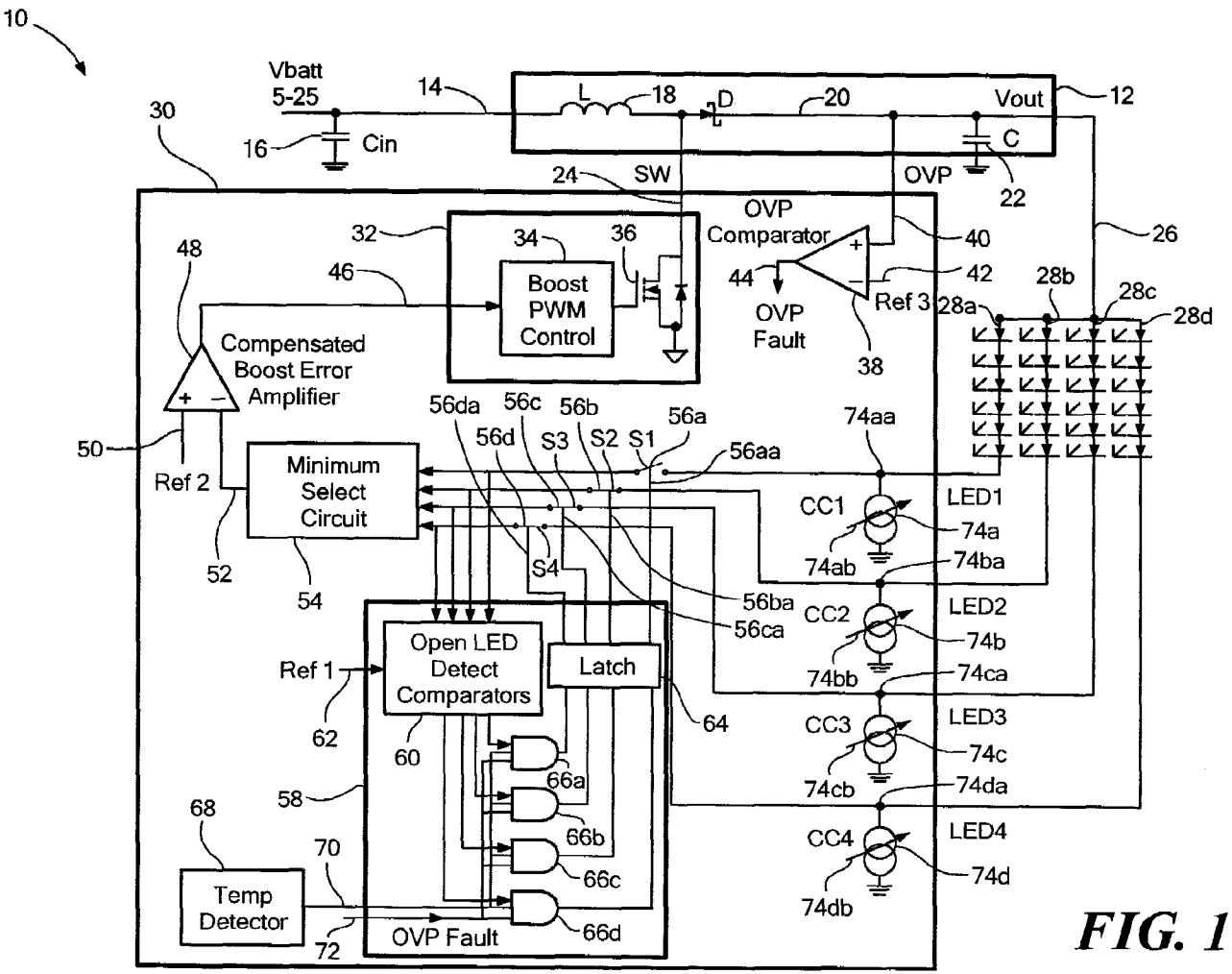
FIG. 1 is a schematic diagram of an electronic circuit for driving a diode load, the electronic circuit having current sinks and an open-circuit detection circuit configured to provide control of a boost switching regulator.

Referring to FIG. 1, an exemplary electronic circuit 10 includes a boost switching regulator 12 coupled to strings of series connected diodes 28*a*-28*d*, which, in some arrangements, are series connected light emitting diodes (LEDs), as may form an LED display. The boost switching regulator 12 and the strings of series connected diodes 28*a*-28*d* are coupled to an integrated circuit 30. The boost switching regulator 12 is configured to accept a voltage at an input node 14 of the boost switching regulator 12 and to generate a relatively higher voltage at an output node 26 of the boost switching regulator 12.

In some embodiments, the boost switching regulator 12 includes an inductor 18 having first and second nodes. The first node of the inductor 12 is coupled to the input node 14 of the boost switching regulator 12. The boost switching regulator 12 also includes a diode 20 having an anode and a cathode. The anode is coupled to the second node of the inductor 14. The boost switching regulator 12 also includes a capacitor 22 coupled to the cathode. The boost switching regulator 12 can include, or is otherwise coupled to, a switching circuit 32 having a switching node 24 coupled to the second node of the inductor 18. In some embodiments, an input capacitor 16 can be coupled to the input node 14 of the boost switching regulator 12.

The integrated circuit 30 includes current regulators 74*a*-74*d*, each having an input node 74*aa*-74*da*, respectively. In the illustrative embodiment, the current regulators 74*a*-74*d* are current sinks. However, in other embodiments described below in conjunction with FIG. 1B, the current sinks 74*a*-74*d* can be replaced with current sources. Each current sink 74*a*-74*d* is configured to sink a predetermined respective regulated current, which can be the same current, into the input nodes 74*aa*-74*da* of the current sinks 74*a*-74*d*, respectively. The integrated circuit 30 also includes an open-circuit detection circuit 58 having input nodes (unlabeled for clarity, but coupled to open LED detect comparators 60) and output nodes (unlabeled for clarity, but from a latching circuit 64). The input nodes of the open-circuit detection circuit 58 are coupled to the input nodes 74*aa*-74*da* of the current sinks 74*a*-74*d*, respectfully. The open-circuit detection circuit 58 is configured to provide output signals at the output nodes (from the latching circuit 64) of the open-circuit detection circuit 58 indicative of a current flowing into the input nodes 74*aa*-74*da* of the current sinks 74*a*-74*d* being below a predetermined current threshold.

The current flowing into the input nodes 74*aa*-74*da* of the current sinks 74*a*-74*d* being below the predetermined current threshold can be identified in a variety of ways. For example, in one particular arrangement, voltages, for example, voltages at the input nodes 74*aa*-74*ad* of the current sinks 74*a*-74*d* are indicative of the current flowing into the input nodes 74*aa*-74*da*. With these arrangements, the voltages can be compared with a first predetermined voltage threshold 62 in order to identify if any one of the voltages is below the first predetermined voltage threshold 62 (indicative of the current flowing through the current regulator being below a predetermined current threshold), a condition that can occur if one of the series connected strings of diode 28*a*-28*d* becomes open circuit. With these arrangements, it will be appreciated that the current nodes 74*aa*-74*da* can also be current sense nodes. This technique is depicted in figures and discussion below.

In other particular embodiments, voltages, for example, voltages at other respective current sense nodes (not shown) of the current sinks 74*a*-74*d* are indicative of the current flowing into the input nodes 74*aa*-74*da*. With these arrangements, the voltages can be compared with the first predetermined voltage threshold 62 in order to identify if any one of the voltages is below the first predetermined voltage threshold 62 (indicative of the current flowing through the current regulator being below a predetermined current threshold).

In yet other particular embodiments, control signals generated by other circuitry (not shown) at respective control nodes 74*ab*-74*bd* of the current sinks 74*a*-74*d* are indicative of the current flowing into the current nodes 74*aa*-74*da*. In some arrangement, the control nodes 74*ab*-74*bd* can be associated with gates of respective FETs (not shown), in which case the control signals can be control voltages. In other arrangements, the control nodes are associated with bases of junction transistors (not shown), in which case the control signals can be control currents. With the FET arrangements, the control voltages can be compared with the first predetermined voltage threshold 62 in order to identify if any one of the voltages is below the first predetermined voltage threshold 62. With the junction transistor arrangements, the control currents can be converted to voltages and can also be compared with the first predetermined voltage threshold 62 in order to identify if any one of the voltages is below the first predetermined voltage threshold 62. In both arrangements, the sensed level is indicative of the current flowing through the current regulator being below a predetermined current threshold.

In all of the above arrangements, the current regulators 74*a*-74*d*, shown as current sinks 74*a*-74*d* have a respective node, which can be sensed (referred to herein as a "current sense" node), in order to measure a current flowing through the current regulator. The current sense node can be the same node or a different node from the "current node," which supplies or which draws current.

The integrated circuit 30 also includes switches 56*a*-56*d* having input nodes (unlabeled for clarity), output nodes (unlabeled for clarity), and control nodes 56*aa*-56*da*, respectively. The input nodes of the switches 56*a*-56*d* are coupled to the input nodes 74*aa*-74*ad* of the current sinks 74*a*-74*d*, respectively. The output nodes of the switches 56*a*-56*d* are coupled to the input nodes of the open-circuit detection circuit 58 (i.e., to the open LED detect comparators 60). The control nodes 56*aa*-56*da* of the switches 56*a*-56*d*, respectively, are coupled to the output nodes of the open-circuit detection circuit 58 (i.e., to the latching circuit 64). The open-circuit detection circuit 58 is configured to open one or more of the switches 56*a*-56*d* in response to the voltage at the input nodes 74*aa*-74*da* of a respective one or more of the current sinks 74*a*-74*d* being below the first predetermined voltage threshold 62 (i.e., the current flowing through a current regulator 74*a*-74*d* being below the predetermined current threshold). Thus, when the voltage at one or more of the input nodes 74*aa*-74*da* is less than the first predetermined voltage threshold 62, the respective input node(s) of the open-circuit detection circuit 58 are decoupled from the input nodes 74*aa*-74*da* of the current sinks 74*a*-74*d*, respectively.

In some embodiments, the open-circuit detection circuit 58 includes the open LED detect comparators 60 having input nodes and output nodes. The input nodes of the open detect comparators 60 are coupled to the input nodes of the open-circuit detection circuit 58. The open detect comparators 60 are configured to compare voltages appearing at respective input nodes with the first predetermined voltage threshold 62. In some embodiments, the open-circuit detection circuit 58 also includes first logic gates 60*a*-60*d*, each having a respective input node and a respective output node. In the illustrative embodiment, the first logic gates 66*a*-66*d* are AND gates, however, in other embodiments, other logic gate structures can also be used. The input nodes of the first logic gates 66*a*-66*d* are coupled to the output node of the open LED detect comparators 60. In some embodiments, the open-circuit detection circuit 58 also includes the latching circuit 64 having input nodes and output nodes. The input nodes of the latching circuit 64 are coupled to the output nodes of the first logic gates 66*a*-66*d*, and the output nodes of the latching circuit 64 are coupled to the output nodes of the open-circuit detection circuit 58.

In some arrangements, the latching circuit 64 can be reset via an enable port (not shown), which can be activated in a number of ways, including, but not limited to activation upon recycling power to the integrated circuit 30, or at any time the series connected strings of LEDs 28*a*-28*d* are turned off, for example, during a standby mode.

In some embodiments, the integrated circuit 30 also includes a minimum select circuit 54 having input nodes and an output node 52. The input nodes of the minimum select circuit 54 are coupled to the output nodes of the switches 54*a*-54*d*. The minimum select circuit 54 is configured to provide a signal at the output node 52 of the minimum select circuit 54 indicative of a signal (e.g., a voltage) at the output nodes of the switches 56*a*-56*d*. In particular, the signal at the output node 52 of the minimum select circuit 54 is indicative of a lowest one of the signals (e.g., voltages) at the output nodes of the switches 54*a*-54*d*, and therefore, a lowest voltage at the input nodes 74*aa*-74*da* of the current sinks 74*a*-74*d*, which can be indicative of a lowest current flowing through a current sink, i.e., an open-circuit condition. Therefore, the signal at the output node 52 of the minimum select circuit 54 is indicative of a largest voltage drop of the series connected LED strings 28*a*-28*d*. One of ordinary skill in the art will be able to design the minimum select circuit 54 having internal comparators and switches, so that an analog output voltage at the output node 52 is indicative of a lowest analog voltage at the input nodes of the minimum select circuit 54.

In some embodiments, the integrated circuit 30 also includes an error amplifier 48 coupled to receive the output signal from the output node 52 of the minimum select circuit 54 and to compare the output signal from the minimum select circuit 54 with a second predetermined voltage threshold 50.

In some embodiments, the integrated circuit 30 also includes the switching circuit 32 having the switching node 24 and a control node 46. The control node 46 of the switching circuit is coupled to the output node of the error amplifier 48, and therefore, to the output node 52 of the minimum select circuit 54. A duty cycle of the switching circuit 32 is responsive to the signal at the output node 52 of the minimum select circuit 54.

In operation, it should be apparent that, if one or more of the series connected LED strings 28*a*-28*d* fails, i.e., becomes open circuit, the open circuit condition can be detected by the open-circuit detection circuit 58, resulting in an opening of an associated one or more of the switches 56*a*-56*d*. The opening of one or more of the switches 56*a*-56*d* results in a respective one or more of the voltages at the input nodes 74*aa*-74*da* of the current sinks 74*a*-74*d* not being considered by the minimum select circuit 54, and therefore, not being involved in control of the duty cycle of the switching circuit 32 or of the voltage at the output node 26 of the boost switching regulator 12.

In some embodiments, the integrated circuit 30 also includes an over-voltage detection circuit 38 having an input node 40 and an output node 44. The output node 44 of the over-voltage protection circuit 38 is coupled to another input node 72 of the open-circuit detection circuit 58. The over-voltage detection circuit 38 is configured to provide an output signal at the output node 44 of the over-voltage protection circuit 38 indicative of a voltage at the input node 40 of the over-voltage detection circuit 38 being above a third predetermined voltage threshold 42. With this arrangement, the output signals at the output nodes of the open-circuit detection circuit 58 are indicative of the voltages at the input nodes 74*aa*-74*da* of the current sinks 74*a*-74*d*, respectively, being below the first predetermined voltage threshold 62 and are also indicative of the voltage at the input node 40 of the over-voltage detection circuit 38 being above the third predetermined voltage threshold 42.

With the over-voltage detection circuit 38, in operation, it should be apparent that, if one or more of the series connected LED strings 28*a*-28*d* fails, i.e., becomes open circuit, the open circuit condition can be detected by the open-circuit detection circuit 58, resulting in an opening of an associated one or more of the switches 56*a*-56*d*, but only when the voltage at the output node 26 of the boost switching regulator 12 rises to the third predetermined voltage threshold 42. The opening of one or more of the switches 56*a*-56*d* results in a respective one or more of the voltages at the input nodes 74*aa*-74*da* of the current sinks 74*a*-74*d*, respectively, not being considered by the minimum select circuit 54, and therefore, not being involved in control of the duty cycle of the switching circuit 32 or of the voltage at the output node 26 of the boost switching regulator 12.

In some embodiments, the integrated circuit 30 also includes a temperature detection circuit 68 having an output node coupled to a yet another input node 70 of the open-circuit detection circuit 58. The temperature detection circuit 68 is configured to provide an output signal at the output node of the temperature detection circuit indicative of a temperature of the electronic circuit 10 (e.g., the integrated circuit 30) being above a predetermined temperature threshold. With this arrangement, the output signal at the output node of the open-circuit detection circuit 58 is indicative of the voltages at the input nodes 74*aa*-74*da* of the current sinks 74*a*-74*d*, respectively, being below the first predetermined voltage threshold 62 and also indicative of the temperature of the electronic circuit 10 being above the predetermined temperature threshold.

With the temperature detection circuit 68, in operation, it should be apparent that, if one or more of the series connected LED strings 28*a*-28*d* fails, i.e., becomes open circuit, the open circuit condition can be detected by the open-circuit detection circuit 58, resulting in an opening of an associated one or more of the switches 56*a*-56*d*, but only when the temperature detected by the temperature detection circuit 68 is above the predetermined temperature threshold and only when the voltage at the output node 26 of the boost switching regulator 12 rises to the third predetermined voltage threshold 42. The opening of one or more of the switches 56*a*-56*d* results in a respective one or more of the voltages at the input nodes 74*aa*-74*da* of the current sinks 74*a*-74*d*, respectively, not being considered by the minimum select circuit 54, and therefore, not being involved in control of the duty cycle of the switching circuit 32 or of the voltage at the output node 26 of the boost switching regulator 12. In some other arrangements, the integrated circuit 30 has either the temperature detection circuit 68 or the over-voltage detection circuit 38, but not both.

In some alternate arrangements, the input nodes of the open-circuit detection circuit 58 (i.e., the open LED detect comparators 60) are instead coupled to the input nodes of the switches 56*a*-56*d*, e.g., to the current sense nodes 74*aa*-74*ad*, respectively.

In some alternate embodiments, some portions of the circuitry shown within the integrated circuit 30 are not within the integrated circuit 30. Partitioning of circuitry between integrated and discrete can be made in any way.

Figure 1A:
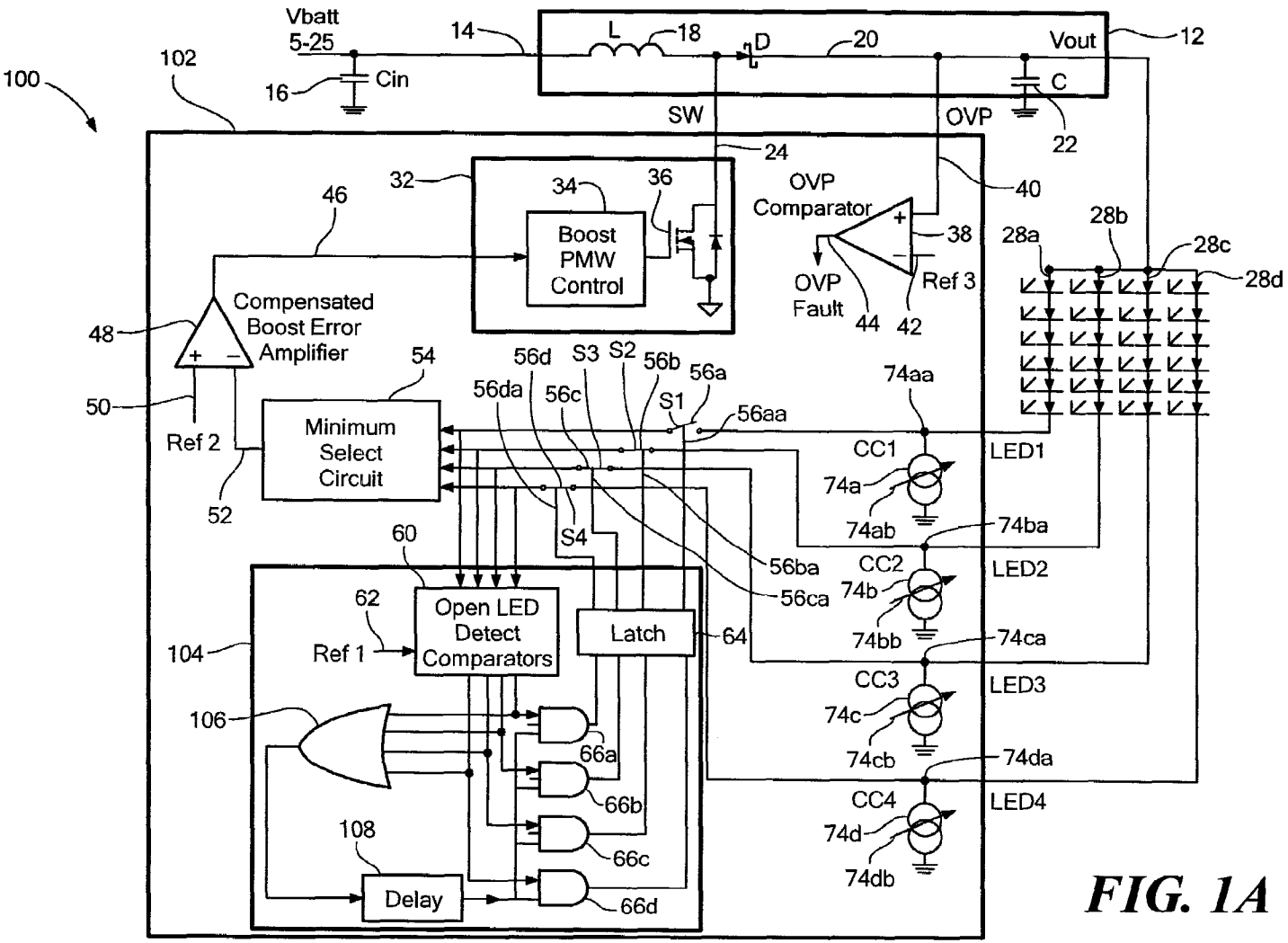
FIG. 1A is a schematic diagram of another electronic circuit for driving a diode load, the electronic circuit having the current sinks and another open-circuit detection circuit configured to provide control of a boost switching regulator.
Figure 1B:
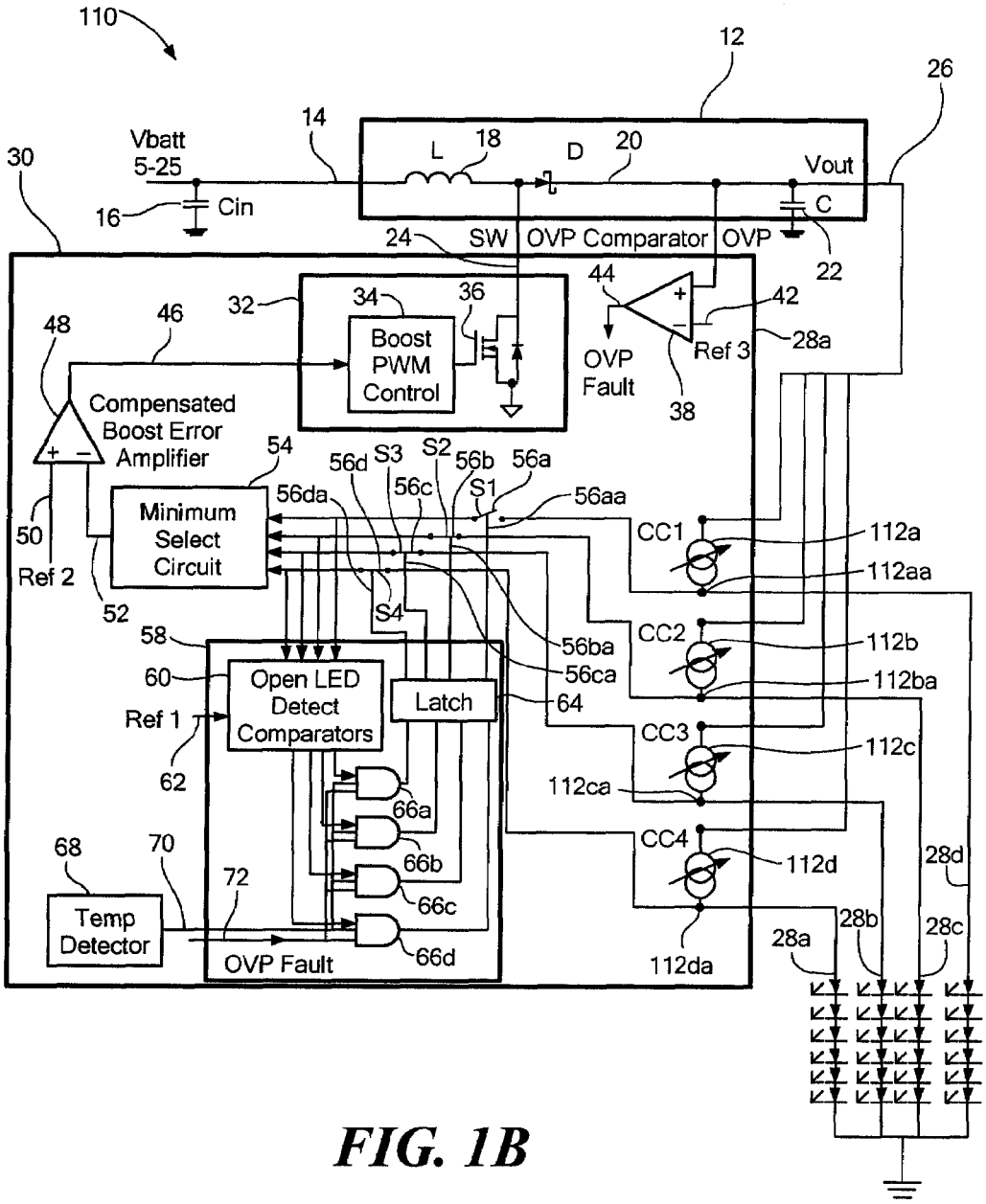
FIG. 1B is a schematic diagram of another electronic circuit for driving a diode load, the electronic circuit having current sources and an open-circuit detection circuit configured to provide control of a boost switching regulator.

While the current regulators 28*a*-28*d* are shown to be current sinks 28*a*-28*d* in the illustrative electronic circuit 10, as described more fully blow in conjunction with FIG. 1B, in other arrangements, the current regulators can be current sources.

Referring now to FIG. 1A, in which like elements of FIG. 1 are shown having like reference designations, another exemplary electronic circuit 100 includes a modified integrated circuit 102 having a different open-circuit detection circuit 104. The open-circuit detection circuit 104 includes a second logic gate 106, here an OR gate, coupled to the open detect comparators 60 and to a delay module 108. The delay module 108 is coupled to further inputs of the first logic gates 66*a*-66*b*.

With this particular arrangement, in operation, it should be apparent that, if one or more of the series connected LED strings 28*a*-28*d* fails, i.e., becomes open circuit, the open circuit condition can be detected by the open-circuit detection circuit 58, resulting in an opening of an associated one or more of the switches 56*a*-56*d*, but only after a delay provided by the delay module 106. Therefore, transient behavior, which can result from electrical noise or the like, is avoided. As described above, the opening of one or more of the switches 56*a*-56*d* after the delay results in a respective one or more of the voltages at the input nodes 74*aa*-74*da* of the current sinks 74*a*-74*d*, respectively, not being considered by the minimum select circuit 54, and therefore, not being involved in control of the duty cycle of the switching circuit 32 or of the voltage at the output node 26 of the boost switching regulator 12. In some arrangements, the integrated circuit 10 also has the temperature detection circuit 68 (FIG. 1) and/or the over-voltage detection circuit 38 (FIG. 1) coupled as described above in conjunction with FIG. 1.

Referring now to FIG. 1B, in which like elements of FIG. 1 are shown having like reference designations, an electronic circuit 110 is similar to the electronic circuit 10 of FIG. 1. However, the current sinks 74*a*-74*d* of FIG. 1 are essentially replaced by current sources 112*a*-112*d*, having respective current sense nodes 112*aa*-112*da*, which are also current output nodes, in place of the current sense nodes 74*aa*-74*da* of FIG. 1, which are also current input nodes.

Unlike the arrangement of FIG. 1, in this arrangement, the current regulators 112*a*-112*d* are coupled between the output node 26 of the boost switching regulator 12 and the series connected strings of LEDs 74*a*-74*d*. The cathode ends of the series connected strings of LEDs 74*a*-74*d* can be coupled to ground or to some other voltage. It will be understood that operation of the electronic circuit 110 can be the same as or similar to the operation of the electronic circuit 10 of FIG. 1.

Figure 2:
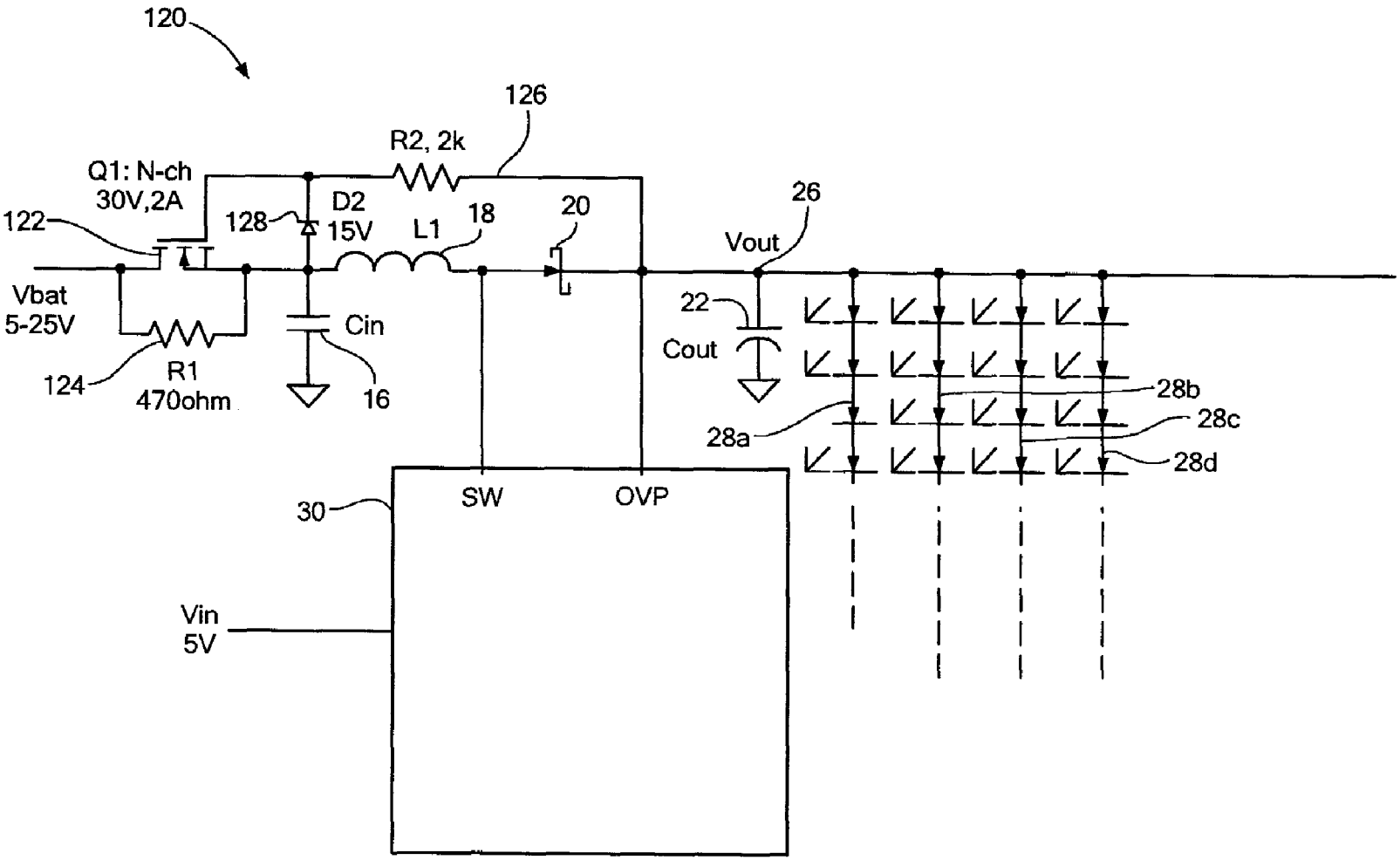
FIG. 2 is a schematic diagram of another electronic circuit for driving a diode load, the electronic circuit having a short circuit protection circuit.

Referring now to FIG. 2, in which like elements of FIG. 1 are shown having like reference designations, an electronic circuit 120 includes an integrated circuit, for example, the integrated circuit 30 of FIG. 1, coupled to the strings of series connected LEDs 28*a*-28*d*. A boost switching regulator, further described below, is coupled at an SW node to the switching circuit 32 of FIG. 1. The boost switching regulator can also be coupled at an OVP node to the over-voltage detection circuit 38 of FIG. 1.

The boost switching regulator includes current limiting provisions not shown in the boost switching regulator 12 of FIG. 1. Like the boost switching regulator 12 of FIG. 1, the boost switching regulator includes the inductor 18, diode 20, and output capacitor 22 as described above in conjunction with FIG. 1. In some arrangements, also described above in conjunction with FIG. 1, the boost switching regulator also includes the input capacitor 16.

In the electronic circuit 120, however, the boost switching regulator also includes a switch element 122, here a field effect transistor, coupled between an input voltage source and the first node of the inductor 18, a current passing circuit 124, here a resistor, coupled in parallel with the switch element 122, and a resistor 126 coupled between the output node 26 of the boost switching regulator 12 and a control node of the switch element 122. In some embodiments, the current passing element 124 (resistor) can represent leakage though the switch element 122, and is not a separate component.

In operation, if a short circuit, or a higher than desired load current, appears at the output node 26 of the boost switching regulator, the output voltage at the output node 26 becomes less than the input voltage (Vbat), and the control node of the switch element 122 is pulled downward in voltage, tending to open the switching element 122 and tending to turn off the switching regulator. It will be appreciated however, that a switching signal provided at the SW node can continue to operate, though the switching regulator no longer provides current when in the short circuit condition. A diode 128 provides a voltage clamp with the resistor 126 to protect the switch element 122.

In other arrangements, rather than connecting the control node of the switch element 122 to the resistor 126 as shown, the control node can be coupled to a selected one of the cathodes of one of the diodes in one of the strings of series connected diodes 28*a*-28*d*. By selecting an appropriate one of the cathodes, the switch element 122 will turn back on upon removal of the short circuit condition in much the same way as described below.

When the open circuit or high load condition is removed, the current passing circuit 124 allows a current to flow past the switch element 122 resulting in an increasing voltage at the cathode of the diode 20. The voltage can increase at the cathode in this way, in particular because the switching regulator is coupled only to series connected diodes, which do not draw current until their threshold voltage is reached. When the voltage at the cathode of the diode 20 reaches a sufficient voltage, the switching element closes (or turns on) by way of the resistor 126. Because the switching provided at the SW node of the integrated circuit 30 continues, the switching regulator can resume normal operation once the short circuit or high load condition is removed. Operation upon removal of a short circuit condition is also indicative of operation at startup.

Figure 2A:
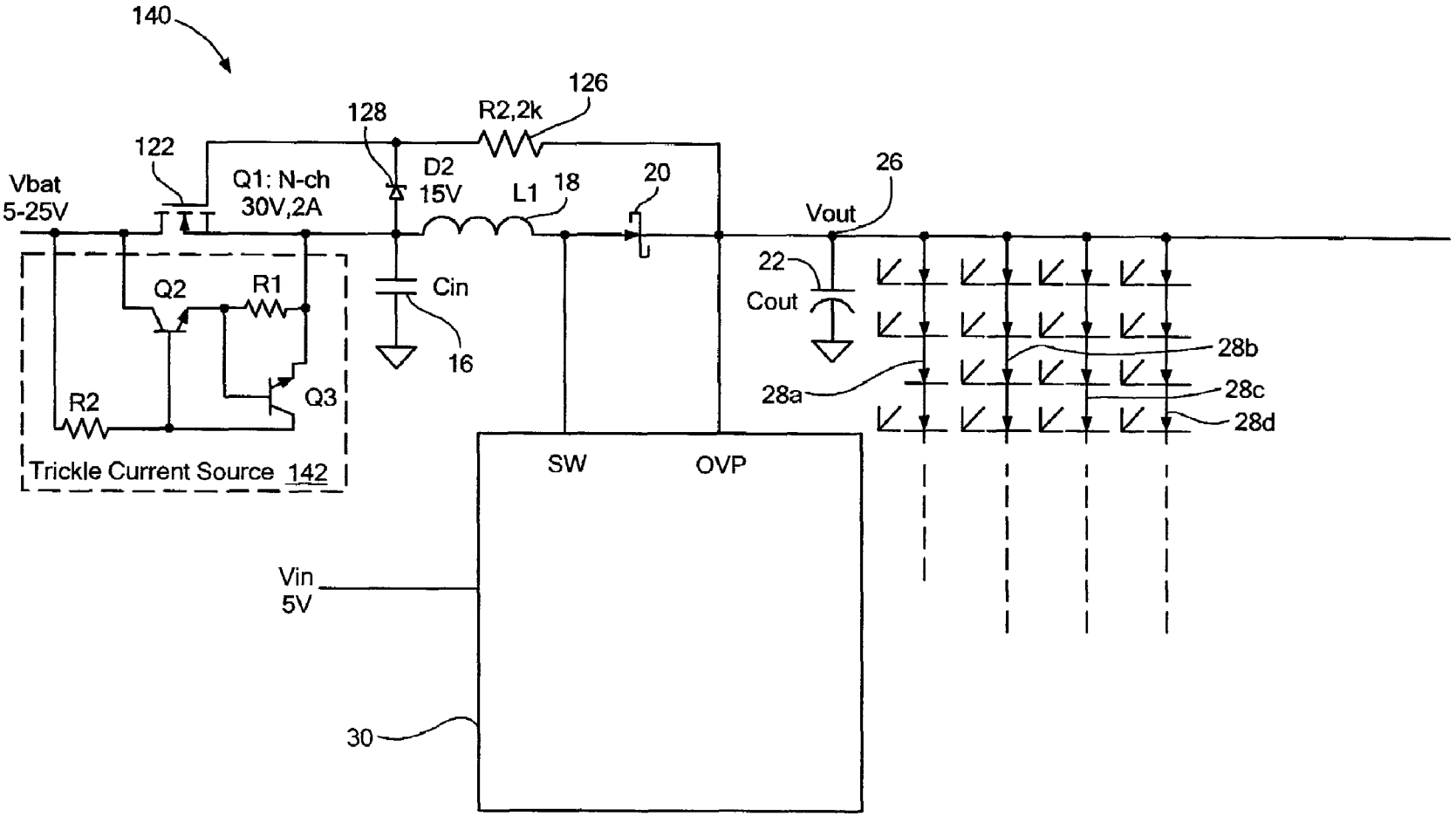
FIG. 2A is a schematic diagram of another electronic circuit for driving a diode load, the electronic circuit having another short circuit protection circuit.

Referring now to FIG. 2A, in which like elements of FIGS. 1 and 2 are shown having like reference designations, an electronic circuit 140 is similar to the electronic circuit 120 of FIG. 2, however, the resistor 124 of FIG. 2 is replaced by as trickle current source 142. The circuit 140 operates in the same manner as the circuit 120 of FIG. 2.

With the arrangements of FIGS. 2 and 2A, a simple short circuit protection scheme is provided whereby the switch element 122 is closed during normal operation and open when a short circuit condition occurs. The current-passing circuits 124, 142 allow the electronic circuits 120, 140, respectively, to start up and to resume operation following removal of a short circuit condition by allowing a small current to pass. This arrangement is possible because the diode load 28*a*-28*d* draws very little current until the switching regulator output voltage reaches a sufficient level.

Figure 3:
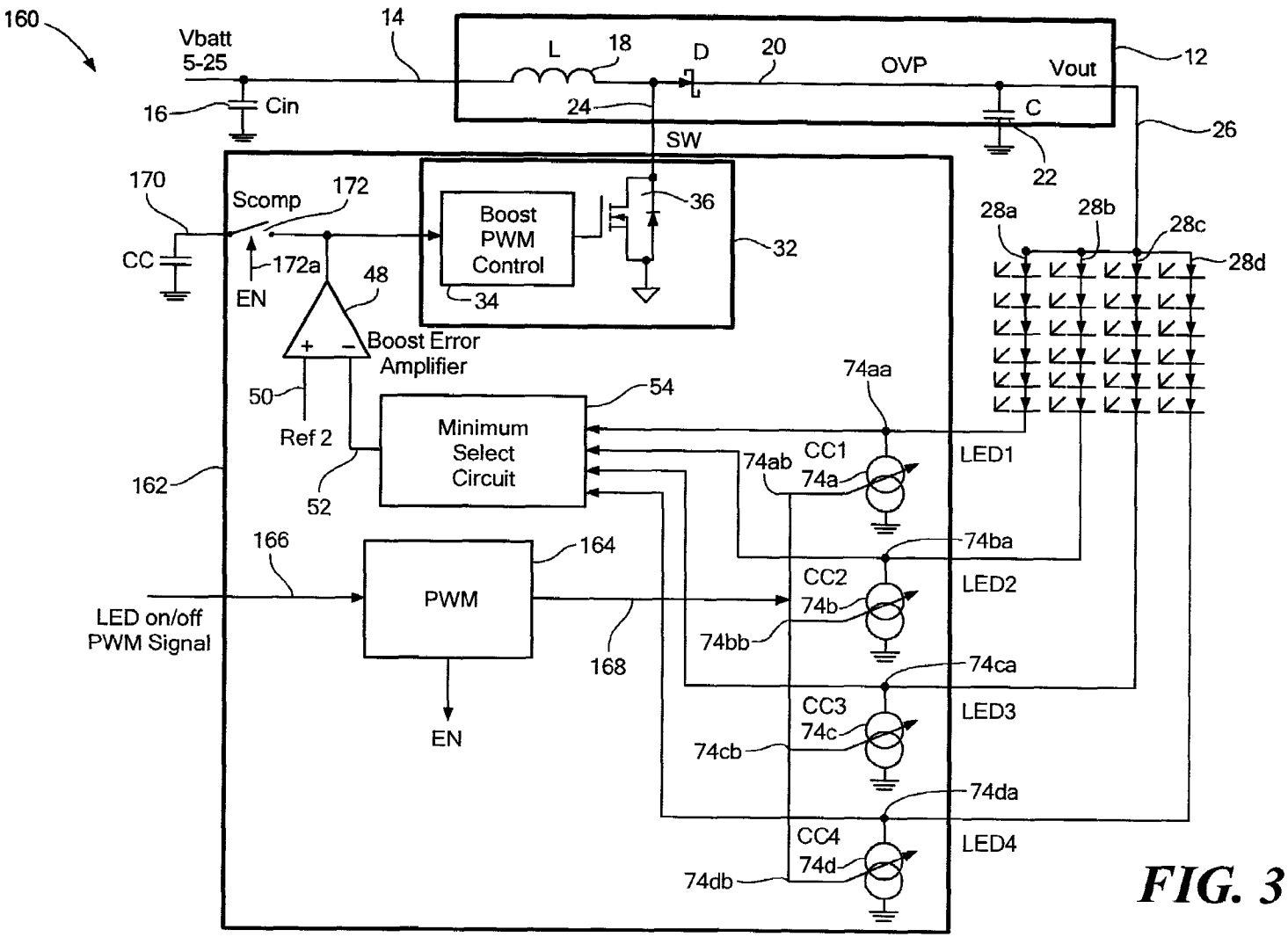
FIG. 3 is a schematic diagram of another electronic circuit for driving a light emitting diode (LED) load, the circuit having a pulse width modulation circuit that can be used for dimming the light emitting diode load.

Referring now to FIG. 3, in which like elements of FIG. 1 are shown having like reference designations, an electronic circuit 160 is similar to the electronic circuit 10 of FIG. 1, but includes provisions for dimming of light emitted by the series connected strings of light emitting diodes 28*a*-28*d*. Also, the open-circuit detection circuit 58, the switches 56*a*-56*d*, the over-voltage detection circuit 38, and the temperature detection circuit 68 of FIG. 1 are not shown, but can be included in some embodiments.

The electronic circuit 160 includes an integrated circuit 162 having a pulse width modulation circuit 164. The pulse width modulation circuit 164 has an output node 168 and a control node 166. The output node 168 of the pulse width modulation circuit 164 is coupled to control nodes 74*ab*-74*db* of the current sinks 74*a*-74*d*. The pulse width modulation circuit 164 is configured to generate an AC output signal at the output node 168 of the pulse width modulation circuit 164, which enables and disables the current sinks 74*a*-74*d* at a predetermined frequency and at a selected duty cycle in response to a respective selected input signal at the input node 166 of the pulse width modulation circuit 164. The duty cycle is selected in accordance with a selected or desired brightness of the series connected light emitting diodes 28*a*-28*d*.

In some particular arrangements (not shown), the pulse width modulation circuit is not within the integrated circuit 162, but instead communicates the AC signal to the control nodes 74*ab*-74*db* by way of a link, for example, a single-wire or multi-wire serial interface, e.g., RS-232, CAN, SMBus, SPI, or I2C.

When the current sinks 74*a*-74*d* are disabled, the minimum select circuit 164 detects the condition of all of the current sinks 74*a*-74*d* being disabled, and, substantially simultaneously with the current sinks 74*a*-74*d* being disabled, the input signal at the control node 46 of the switching regulator (i.e., of the switching circuit 32) is indicative of the boost switching regulator being disabled. Therefore, at substantially the same time that the current sinks 74*a*-74*d* are disabled, the switching circuit 32 stops switching. However, in this particular condition, the output voltage of the switching regulator is held at or near its value prior to the disabled condition by way of the capacitor 22. In other embodiments, the boost switching regulator is disabled within two microseconds to ten milliseconds of the current sinks 74*a*-74*d* being disabled.

In some embodiments, the electronic circuit 160 can also include a switch 172 having an input node, an output node, and a control node 172*a*, wherein the output node of the switch is coupled to the control node 46 of the boost switching regulator (i.e., of the switching circuit 32). The control node 172*a* of the switch 172 is coupled to the pulse width modulation circuit 164. The switch 172 is closed when the current sinks 74*a*-74*d* are enabled and open when the current sinks 74*a*-74*d* are disabled. The electronic circuit 160 can also include a capacitor 170 coupled to the input node of the switch 172. The capacitor 170 holds a voltage when the switch 172 is open, corresponding to a voltage of the control node 46 of the switching regulator (i.e., of the switching circuit 32) when the switch 172 is closed. With this arrangement, when the switch 172 is opened as the current sinks 74*a*-74*d* are disabled, the capacitor 170 can hold the control voltage of the switching circuit 32 accordingly. Therefore, when the switch 172 is again closed as the current sinks 74*a*-74*d* are again enabled, the control voltage at the control node 46 is at a value substantially equal to its previous voltage.

With this arrangement, the output voltage at the output node 26 of the switching regulator is held substantially constant during intervals when the current sinks 74*a*-74*d* are disabled by the pulse width modulation circuit 164. In this way, audible noise that may otherwise be generated due to voltage swings on ceramic capacitors is reduced or eliminated.

The error amplifier 48 can be a transconductance amplifier, which provides a current in response to a voltage at the output node 52 of the minimum select circuit.

The on-off frequency of the signal at the output node 168 of the pulse width modulation circuit 164 can be predetermined to provide an illumination of the series connected strings of LEDs 28*a*-28*d*, without apparent flicker. For example, the frequency can be a predetermined value between about twenty and one thousand Hertz. However, these limits may be extended based on the specific applications retirements. The on-off duty cycle of the signal at the output node 168 of the pulse width modulation circuit 164 can be selected according to the input signal provided at the input node 166 to the pulse width modulation circuit 164, and according to a selected (or user-desired) brightness of the series connected strings of LEDs 28*a*-28*d*. The duty cycle can be selected anywhere in a range of zero to one hundred percent. The duty cycle can be selected from time to time by a user. In some arrangements, for example, the signal at the input node 166, and the resulting brightness of the series connected strings of LEDs 28*a*-28*d*, is selected with a keyboard control on a laptop computer.

It should be understood that the various embodiments shown herein can be combined together into one electronic circuit or they can be separately used in different embodiments.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. An open circuit protection method for an LED driver circuit comprising a boost switching regulator, the method comprising:

drawing a respective predetermined current through each of a plurality of LEDs and through a respective plurality of current regulators;

detecting a smallest current passing through one of the plurality of current regulators; and detecting a respective current passing through each one of the plurality of current regulators to determine whether the respective current is less than a predetermined current threshold; wherein the detecting the smallest current does not take into account a current passing through at least one of the plurality of current regulators that is less than the predetermined current threshold.

2. The method of claim 1, further comprising:

detecting whether an output voltage of the boost switching regulator is greater than a predetermined voltage threshold, wherein the detecting the smallest current does not take into account the current passing through the at least one of the plurality of current regulators that is less than the predetermined current threshold only if the output voltage of the boost switching regulator is greater than the predetermined voltage threshold.

3. The method of claim 1, further comprising:

detecting whether a temperature of the LED driver circuit is greater than a predetermined temperature threshold, wherein the detecting the smallest current does not take into account the current passing through the at least one of the plurality of current regulators that is less than the predetermined current threshold only if the temperature of the LED driver circuit is greater than the predetermined temperature threshold.

4. The method of claim 1, further comprising:

regulating an output voltage of the boost switching regulator in accordance with the detected smallest current.

5. The method of claim 1, further comprising:

disconnecting the at least one of the plurality of current regulators from a minimum current selection circuit in response to a determination that the current passing through the at least one of the plurality of current regulators is less than the predetermined current threshold.

6. The method of claim 1, wherein the detecting the respective current passing through each one of the plurality of current regulators comprises detecting an open circuit in at least one LED of the plurality of LEDs.

7. The method of claim 1, wherein the predetermined current threshold is representative of an open circuit in at least one LED of the plurality of LEDs.

8. The method of claim 1, further comprising pulse width modulating the plurality of current regulators in accordance with a pulse width modulated signal in order to affect an average current passing though the plurality of current regulators in accordance with selected on-state periods of the pulse width modulated signal in order to select a brightness of the plurality of LEDs.

9. The method of claim 8, further comprising:

holding a control voltage signal during off-state periods of the pulse width modulated signal and controlling the control voltage signal during the on-state periods of the pulse width modulated signal; and controlling the boost switching regulator with a signal representative of the control voltage signal.

10. The method of claim 1, further comprising:

generating a signal indicative of whether the current passing through the at least one of the plurality of current regulators is less than the predetermined current threshold.

11. The method of claim 10, further comprising:

disconnecting the at least one of the plurality of current regulators from a minimum current selection circuit in response to the signal.

12. The method of claim 11, further comprising providing a delayed detection signal that is a delayed version of a signal indicative of whether the current passing through the at least one of the plurality of current regulators is less than the predetermined current threshold, wherein the disconnecting comprises disconnecting the at least one of the plurality of current regulators in response to the delayed detection signal.

* * * * *

UNITED STATES PATENT AND TRADEMARK OFFICE

CERTIFICATE OF CORRECTION

PATENT NO. : 7,675,245 B2
APPLICATION NO. : 11/619675
DATED : March 9, 2010
INVENTOR(S) : Gregory Szczeszynski et al.

It is certified that error appears in the above-identified patent and that said Letters Patent is hereby corrected as shown below:

On the Title Page
Item (75) Inventors: delete "Gregory Szezeszynski, Nashua, NH (US)" and replace with --Gregory Szezeszynski, Nashua, NH (CA)--.

Item (75) delete "Shashank Wekhande, Nashua, NH (US)" and replace with --Shashank Wekhande, Nashua, NH (IN)--.

Column 1, line 67 delete "increased" and replace with --increase--.

Column 5, line 50 delete "diode" and replace with --diodes--.

Column 5, line 67 delete "arrangement," and replace with --arrangements,--.

Column 6, line 60 delete "node" and replace with --nodes--.

Column 8, line 20 delete "to a yet" and replace with --to yet--.

Column 8, line 65 delete "blow" and replace with --below--.

Column 10, line 3 delete "though" and replace with --through--.

Column 10, line 43 delete "as" and replace with --a--.

Column 11, line 13 delete "circuit is" and replace with --circuit 164 is--.

Column 13, line 13 delete "though" and replace with --through--.

Signed and Sealed this

Twelfth Day of October, 2010

David J. Kappos

David J. Kappos
*Director of the United States Patent and Trademark Office*